US010852117B2

(12) United States Patent
Guyon

(10) Patent No.: US 10,852,117 B2
(45) Date of Patent: Dec. 1, 2020

(54) ELECTRONIC DETONATOR FIRING METHOD, AND ELECTRONIC DETONATOR

(71) Applicant: DAVEY BICKFORD, Hery (FR)

(72) Inventor: Franck Guyon, Auxerre (FR)

(73) Assignee: DAVEY BICKFORD, Hery (FR)

( * ) Notice: Subject to any disclaimer, the term of this patent is extended or adjusted under 35 U.S.C. 154(b) by 190 days.

(21) Appl. No.: 15/773,424

(22) PCT Filed: Nov. 2, 2016

(86) PCT No.: PCT/FR2016/052829

§ 371 (c)(1),
(2) Date: May 3, 2018

(87) PCT Pub. No.: WO2017/077228

PCT Pub. Date: May 11, 2017

(65) Prior Publication Data

US 2018/0321024 A1 Nov. 8, 2018

(30) Foreign Application Priority Data

Nov. 4, 2015 (FR) ..... 15 60578

(51) Int. Cl.

| | |
|---|---|
| ***F42D 1/05*** | (2006.01) |
| ***F42B 3/12*** | (2006.01) |
| ***F42C 11/06*** | (2006.01) |
| ***F42D 1/055*** | (2006.01) |

(52) U.S. Cl.
CPC ..... *F42D 1/055* (2013.01); *F42B 3/121* (2013.01); *F42C 11/06* (2013.01)

(58) Field of Classification Search
CPC ... F42D 1/04; F42D 1/045; F42D 1/05; F42D 1/055; F42B 3/10; F42B 3/12; F42B 3/121; F42B 3/122; F42C 11/00; F42C 11/06; F42C 11/065; F42C 19/12
USPC ..... 102/215, 217
See application file for complete search history.

(56) References Cited

U.S. PATENT DOCUMENTS 4,712,477 A * 12/1987 Aikou ..... F42C 11/06 102/202.5
4,825,765 A 5/1989 Ochi et al.
5,460,093 A 10/1995 Prinz et al.
(Continued)

FOREIGN PATENT DOCUMENTS

EP 0 386 860 A2 9/1990
EP 1 482 271 A1 12/2004
(Continued)

OTHER PUBLICATIONS

International Search Report, dated Jan. 31, 2017, from corresponding PCT application No. PCT/FR2016/052829.

*Primary Examiner* — James S Bergin
(74) *Attorney, Agent, or Firm* — Nixon & Vanderhye

(57) ABSTRACT

Disclosed is a method for firing an electronic detonator including a power storage unit including receiving, via the electronic detonator, a firing order. The following steps are implemented as long as the delay time associated with the electronic detonator has not elapsed since the reception of the firing order: measuring power stored in the power storage unit, and firing the electronic detonator when the measured stored power is less than or equal to a predetermined power.

13 Claims, 3 Drawing Sheets

(56) References Cited

U.S. PATENT DOCUMENTS

| | | | | |
|---|---|---|---|---|
| 5,602,360 | A * | 2/1997 | Sakamoto | F42B 3/121 102/202.13 |
| 5,602,713 | A * | 2/1997 | Kurogi | F42C 11/06 361/249 |
| 6,618,237 | B2 * | 9/2003 | Eddy | F42B 3/121 102/217 |
| 7,116,543 | B2 | 10/2006 | Kim et al. | |
| 2003/0029344 | A1 | 2/2003 | Eddy et al. | |

FOREIGN PATENT DOCUMENTS

| | | | |
|---|---|---|---|
| WO | 95/04253 | A1 | 2/1995 |
| ZA | 9606213 | | 2/1997 |

* cited by examiner

ELECTRONIC DETONATOR FIRING METHOD, AND ELECTRONIC DETONATOR

BACKGROUND OF THE INVENTION

Field of the Invention

The present invention relates to a method for firing an electronic detonator, as well as an electronic detonator implementing the firing method.

Description of the Related Art

Generally, a set of electronic detonators is connected to one and the same control system, the control system being configured in order to manage the operation of the electronic detonators, as well as for supplying them.

Each electronic detonator is connected to the control system using electrically conducting wires (corresponding to the wires of the detonator, the busline and the firing line), and comprises in particular a detonating charge or explosive, an electronically actuated ignition module or fuse, and means for storing a firing delay time, this delay time corresponding to the countdown time between the reception by the electronic detonator of a firing command or order and the actual firing.

Thus, an electronic detonator moreover comprises electronic circuits configured in order to reproduce the firing delay time, for example by carrying out a countdown corresponding to the delay time since reception of the firing command or order.

In certain cases (for example when the electrically conducting wires have been cut by one of the previous detonations), once the control system transmits a firing command, the electronic detonators are no longer supplied by the control system, supplying each electronic detonator being ensured by energy storage means embedded in each detonator.

The energy storage means embedded in an electronic detonator make it possible, as well as supplying the various electronic circuits in the detonator such as the circuits reproducing the delay time, to store the energy necessary for firing the electronic detonator.

If the energy stored in the energy storage means reduces so that the electronic circuits means are not supplied, the firing delay time is not reproduced, the firing of the electronic detonator not being implemented.

Similarly, the electronic detonator is not fired if the energy stored in the energy storage means reduces so that there is insufficient energy for the firing in the energy storage means, in particular once the delay time has elapsed.

Failure in the firing of an electronic detonator presents a significant safety risk.

BRIEF SUMMARY OF THE INVENTION

A purpose of the present invention is to propose a method for firing an electronic detonator, as well as an electronic detonator in which safety is improved.

In this respect, according to a first aspect the present invention relates to a method for firing an electronic detonator comprising energy storage means, the method comprising reception by the electronic detonator of a firing order.

According to the invention the method comprises the following steps, which are implemented as long as a delay time associated with the electronic detonator has not elapsed since said reception of the firing order:

measuring the energy stored in the energy storage means, and firing the electronic detonator when the measured stored energy is less than or equal to a predetermined energy.

Thus, as soon as the electronic detonator receives a firing order and as long as the delay time associated with the electronic detonator has not elapsed, the energy stored in the energy storage means is monitored so as to fire the electronic detonator if the measured stored energy is less than or equal to a predetermined energy.

As a result, the method allows the firing of an electronic detonator despite the fact that the delay time which is associated with it has not elapsed since reception of the firing command.

This represents a means of controlling the firing of the electronic detonator other than by the countdown of the delay time and thus improving safety with respect to the electronic detonator.

For example, the predetermined energy corresponds to a minimum energy necessary for supplying and for firing the electronic detonator.

As a result, when the energy stored in the energy storage means reaches a minimum value that no longer allows the supply and/or the firing of the electronic detonator, the firing of the electronic detonator is implemented without waiting for the delay time to elapse.

In fact, when the stored energy is greater than the predetermined energy, the energy storage means contain the energy necessary for supplying the electronic detonator and for the actual firing.

On the contrary, when the stored energy reaches the predetermined energy or is less than the predetermined energy, there is a risk of non-firing of the electronic detonator.

Thus, the electronic detonator is fired as soon as the energy stored in the energy storage means reaches the predetermined energy in order to avoid the electronic detonator never firing.

It will be noted that if the stored energy is less than the predetermined energy, either the countdown of the delay time cannot be implemented and as a result the electronic detonator will never be fired even though there remains the energy necessary for the firing, or the countdown of the delay time can be implemented but the remaining energy in the storage means is not sufficient for the firing, or the remaining energy is not sufficient either for the supply or for the firing of the electronic detonator.

According to a feature, the firing method moreover comprises a step of comparing the measured stored energy with the predetermined energy.

According to a feature, the step of measuring the stored energy comprises a step of measuring a voltage at the terminals of the energy storage means, and the comparison step comprises a step of comparing the measured voltage with a predetermined voltage representative of the predetermined energy.

Thus, when the measured voltage at the terminals of the energy storage means is less than or equal to the predetermined voltage, the step of firing the electronic detonator is implemented before the delay time has elapsed.

In fact, if the measured voltage at the terminals of the energy storage means is less than or equal to the predetermined voltage, the electronic detonator is fired before the energy stored by the energy storage means is no longer sufficient for the electronic detonator to be fired.

Thus, the electronic detonator is fired while there remains sufficient energy to supply it, and to initiate the detonating charge of the electronic detonator.

It follows that as long as the voltage measured at the terminals of the energy storage means is not less than the predetermined voltage, the countdown of the delay time continues and the firing step of the electronic detonator is implemented once the delay time associated with the electronic detonator has elapsed.

According to an embodiment, when the measured stored energy is less than or equal to said predetermined energy, the method further comprises a step of determining the time difference existing between a period of time elapsed since reception of the firing order and the delay time associated with the electronic detonator, said firing step being implemented when said time difference is less than a predetermined time value.

Thus, according to this embodiment, even though it has been noted that the measured stored energy is less than or equal to the predetermined energy, it is verified if the time difference between the associated delay time and the time elapsed since reception of the firing order is less than a predetermined time value, the firing step only being implemented, if the time difference is less or equal to the predetermined value of the time difference.

On the contrary, if the time difference is greater than the predetermined time value, the countdown of the delay time associated with the electronic detonator continues.

In an embodiment, the step of measuring the stored energy comprises a first step of measuring the stored energy in first energy storage means and a second step of measuring the stored energy in second energy storage means, the firing of the electronic detonator being implemented if the stored energy measured in the first measuring step is less than or equal to a first predetermined energy or if the stored energy measured in the second measuring step is less than or equal to a second predetermined energy.

In this embodiment, the first predetermined energy corresponds to a minimum energy necessary for supplying the electronic detonator and the second predetermined energy corresponds to a minimum energy necessary for firing the electronic detonator.

Moreover, the comparison step comprises a first step of comparing the stored energy measured in the first measuring step with the first predetermined energy and a second step of comparing the stored energy measured in the second measuring step with the second predetermined energy.

In this embodiment, the energy storage means of the electronic detonator thus comprise two different energy storage means, the firing of the electronic detonator being implemented when the stored energy measured in the first measuring step is less than or equal to the first predetermined energy and/or the stored energy measured in the second measuring step is less than or equal to the second predetermined energy.

It is thus possible to separately monitor the minimum energy necessary for firing the electronic detonator and the minimum energy necessary for supplying the electronic detonator.

When one of the energies reaches a minimum value, the electronic detonator is fired in advance.

According to a second aspect, the present invention relates to an electronic detonator comprising energy storage means and means for receiving a firing order.

According to the invention, the electronic detonator further comprises:

means for measuring a stored energy in the energy storage means, and means for firing configured to implement the firing of the electronic detonator before a delay time associated with the electronic detonator has elapsed, when the stored energy measured by the measuring means is less than or equal to a predetermined energy.

According to a feature, the electronic detonator comprises means for comparing the measured stored energy measured by the measuring means with said predetermined energy.

According to a feature, the means for measuring the energy stored in the energy storage means comprises means for measuring the voltage at the terminals of said energy storage means, and the comparison means comprises means for comparing a voltage measured by the measuring means with a predetermined voltage representative of the predetermined energy.

In an embodiment, the energy storage means comprises first energy storage means configured to store the energy necessary for supplying the electronic detonator and second energy storage means configured to store the energy necessary for the firing of the electronic detonator.

Thanks to the different energy storage means for the storage of the energy necessary for supplying the electronic detonator and for the storage of the energy necessary for the firing of the electronic detonator, it is possible to measure the voltage at the terminals of each of said energy storage means and to fire the detonator when one of the voltages is less than or equal to a predetermined voltage.

According to a feature, the energy storage means comprises a capacitor.

According to a third aspect, the present invention relates to a detonation system comprising a set of electronic detonators according to the invention and implementing the firing method according to the invention.

The electronic detonator and the detonation system have similar advantages to those described previously with reference to the firing method according to the invention.

Other features and advantages of the invention will become apparent from the following description.

BRIEF DESCRIPTION OF THE DRAWINGS

In the attached drawings, given as non-limitative examples.

DETAILED DESCRIPTION OF THE PREFERRED EMBODIMENTS

Figure 1:
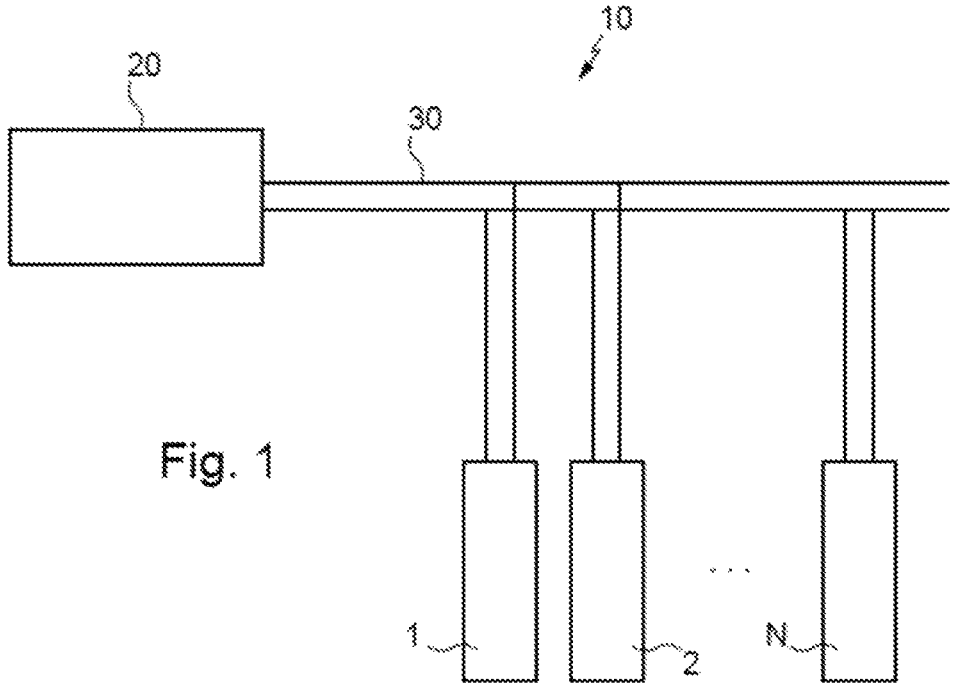
FIG. 1 diagrammatically represents a detonation system according to an embodiment comprising several electronic detonators.

FIG. 1 represents a detonation system comprising several electronic detonators 1, 2, . . . , N.

The electronic detonators 1, 2, . . . , N are connected to a firing unit or control system 20 through electrically conducting wires 30. The electrically conducting wires 30 comprise detonator wires, a busline and a firing line.

A function of the control system 20 is in particular to supply the electronic detonators 1, 2, . . . , N, to verify that they operate correctly and to manage the their operation, for example controlling their firing.

To this end, the control system 20 comprises electronic circuits necessary for managing the operation of the set of electronic detonators and for communicating with them.

Thus, the firing unit or control system 20 generates supply signals as well as control signals, for example test signals or firing signals. These signals are sent via the electrically conducting wires 30 to the electronic detonators 1, 2, . . . , N.

Each electronic detonator 1, 2, . . . , N has a delay time associated with it, for example by reception through the electrically conducting wires 30, the delay time originating from the firing unit 20, or by reception by other wired or wireless means originating from another unit, such as a console or programming unit (not shown in the figure).

Figure 2:
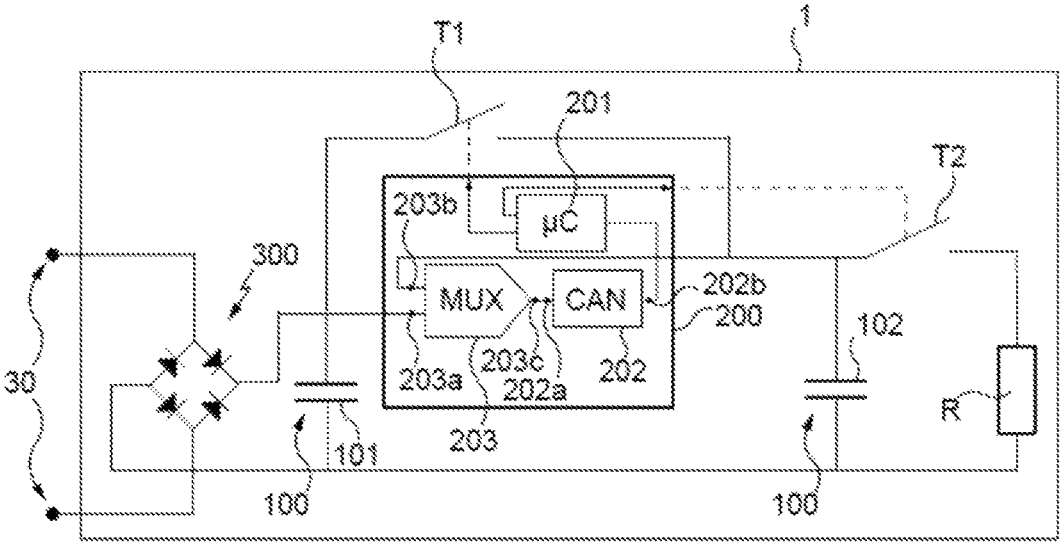
FIG. 2 represents an electronic detonator according to an embodiment of the invention.

FIG. 2 represents an electronic detonator 1 according to an embodiment of the invention.

The essential means for implementing the invention are represented in FIG. 2.

The electronic detonator 1 comprises a heating resistor R intended to fire a detonating charge (not represented in the figure) during the firing of the electronic detonator 1.

The electronic detonator 1 further comprises energy storage means 100 necessary in particular for supplying the electronic detonator 1 in the case where it is not supplied by the firing unit 20, as well as for the actual firing of the electronic detonator 1.

It will be noted that, before a firing order is transmitted by the firing unit 20, the electronic detonator 1 is supplied through the electrically conducting wires 30. In particular, a supply signal originating from the firing unit 20 is rectified by a bridge rectifier 300 connected at the input of the electronic detonator 1, the supply signal charging the energy storage means 100 with energy.

In the embodiment represented in FIG. 2, the energy storage means 100 comprise first energy storage means 101 configured to store the energy necessary for supplying the electronic detonator 1, and second energy storage means 102 configured to store the energy necessary for the firing of the electronic detonator 1.

According to other embodiments, the first and second energy storage means 101, 102 can be replaced by single energy storage means storing the energy necessary for supplying the electronic detonator 1 and for its firing.

In the embodiment represented by FIG. 2, the first and second energy storage means 101, 102 respectively comprise a capacitor.

The capacitor of the first storage means 101 is called supply capacitor 101 and the capacitor of the second storage means 102 is called firing capacitor 102.

Thus, the supply capacitor 101 comprises the energy necessary for maintaining the supply voltage of the electronic detonator 1 and, in particular, of the electronic circuits necessary for the operation of the electronic detonator 1, during a period of time.

The firing capacitor 102 stores the necessary energy making it possible to maintain a voltage necessary for the firing of the electronic detonator 1.

The electronic detonator 1 further comprises a control module 200 comprising electronic circuits necessary for managing the operation of the electronic detonator 1.

For example, the control module 200 controls the opening and closing of the switches T1, T2 making it possible respectively, to charge the firing capacitor 102 and to connect the firing capacitor 102 to the heating resistor R when the electronic detonator 1 is fired.

For example, the control module 200 comprises a microcontroller 201 configured for managing the operation of the electronic detonator 1.

In particular, the microcontroller 201 comprises means for receiving a firing order. This firing order is received from the firing unit 20. It further comprises means for counting the delay time associated with the electronic detonator 1, i.e. the time elapsed since the electronic detonator 1 received the firing order from the firing unit or control system 20 and for initiating the firing once the elapsed time reaches the delay time associated with the electronic detonator 1.

The electronic detonator 1, and in particular the control module 200, moreover comprises means for measuring the stored energy 202 in the energy storage means 100 and means for comparing the measured stored energy with a predetermined energy.

In an embodiment, the means for measuring the energy stored in the energy storage means 100 comprise means for measuring the voltage at the terminals of the energy storage means 100 and the means for comparing the measured stored energy with a predetermined energy comprise means for comparing a voltage with a predetermined voltage.

Thus, in the embodiment represented in FIG. 2, the measuring means comprise means for measuring the voltage at the terminals of the supply capacitor 101 and at the terminals of the firing capacitor 102.

Measurement of the voltage at the terminals of the supply capacitor 101 makes it possible to know whether it contains the energy necessary for supplying the electronic detonator 1, in particular for supplying the electronic circuits managing its operation 200.

Measurement of the voltage at the terminals of the firing capacitor 102 makes it possible to know whether it contains sufficient energy for the actual firing of the electronic detonator 1.

In an embodiment, the means for measuring the stored energy 202 comprise an analog-digital converter 202 (ADC). Thus, the voltage at the terminals of the supply capacitor 101 and of the firing capacitor 102 is measured by means of the analog-digital converter 202.

In this embodiment, the electronic detonator 1 comprises a single analog-digital converter 202 for sampling the voltages at the terminals of the supply capacitor 101 and of the firing capacitor 102. Thus, in this embodiment, the control module 200 comprises a multiplexer 203 having two inputs 203*a*, 203*b* and one output 203*c*.

Of course, the electronic detonator could comprise two analog-digital converters instead of a multiplexer.

In other embodiments, not represented, the means for measuring energy and for comparison may comprise other means, for example means for measuring voltage and for analog comparison.

In the embodiment represented, the first input 203*a* of the multiplexer 203 is connected to the supply capacitor 101 and the second input 203*b* is connected to the blasting capacitor 202. The output 203*c* of the multiplexer 203 is connected to the input 202*a* of the analog-digital converter 202.

The voltage at the terminals of the supply capacitor 101 and the voltage at the terminals of the firing capacitor 102 is sampled by the analog-digital converter 202, each in turn.

In particular, provision is made for the microcontroller 201 to carry out the voltage measurements at the terminals of the supply capacitor 101 and of the firing capacitor 102 periodically and of course one at a time. Conventionally, the voltages at the inputs 203*a*, 203*b* are transmitted to its output 203*c* each in turn.

Thus, when the microcontroller 201 controls the measurement of the voltage at the terminals of the supply capacitor 101, the first input 203*a* of the multiplexer 203 is selected and the voltage at this first input 203*a* is transmitted to the output 203*c* of the multiplexer 203, i.e. to the input 202*a* of the analog-digital converter 202.

In the embodiment described, the voltage measured at the terminals of the supply 101 and firing 102 capacitors may be compared respectively with a predetermined voltage representative of a predetermined energy.

Of course, the predetermined voltages for the supply capacitor 101 and for the firing capacitor 102 can have different values.

The measurement and the comparison of the voltages will be described subsequently with reference to FIG. 3.

The output of the analog-digital converter 202*b* is sent to the microcontroller 201 where the comparison means will compare the voltage received from the analog-digital converter 202 with a predetermined voltage representative of a predetermined energy.

In an embodiment, the predetermined energy corresponds to the minimum energy necessary for supplying the electronic detonator 1 and for firing it.

It will be noted that the predetermined energy takes account of a margin corresponding to the time elapsed between the time at which it is noted that the electronic detonator 1 must be fired in advance and the actual moment of the firing.

In another embodiment, not represented in the figures, the energy storage means comprise a single capacitor in which the necessary energy makes it possible to maintain an adequate voltage for supplying the electronic detonator and for its firing.

In this embodiment, the analog-digital converter directly samples the voltage at the terminals of said capacitor, without requiring a multiplexer.

Figure 3:
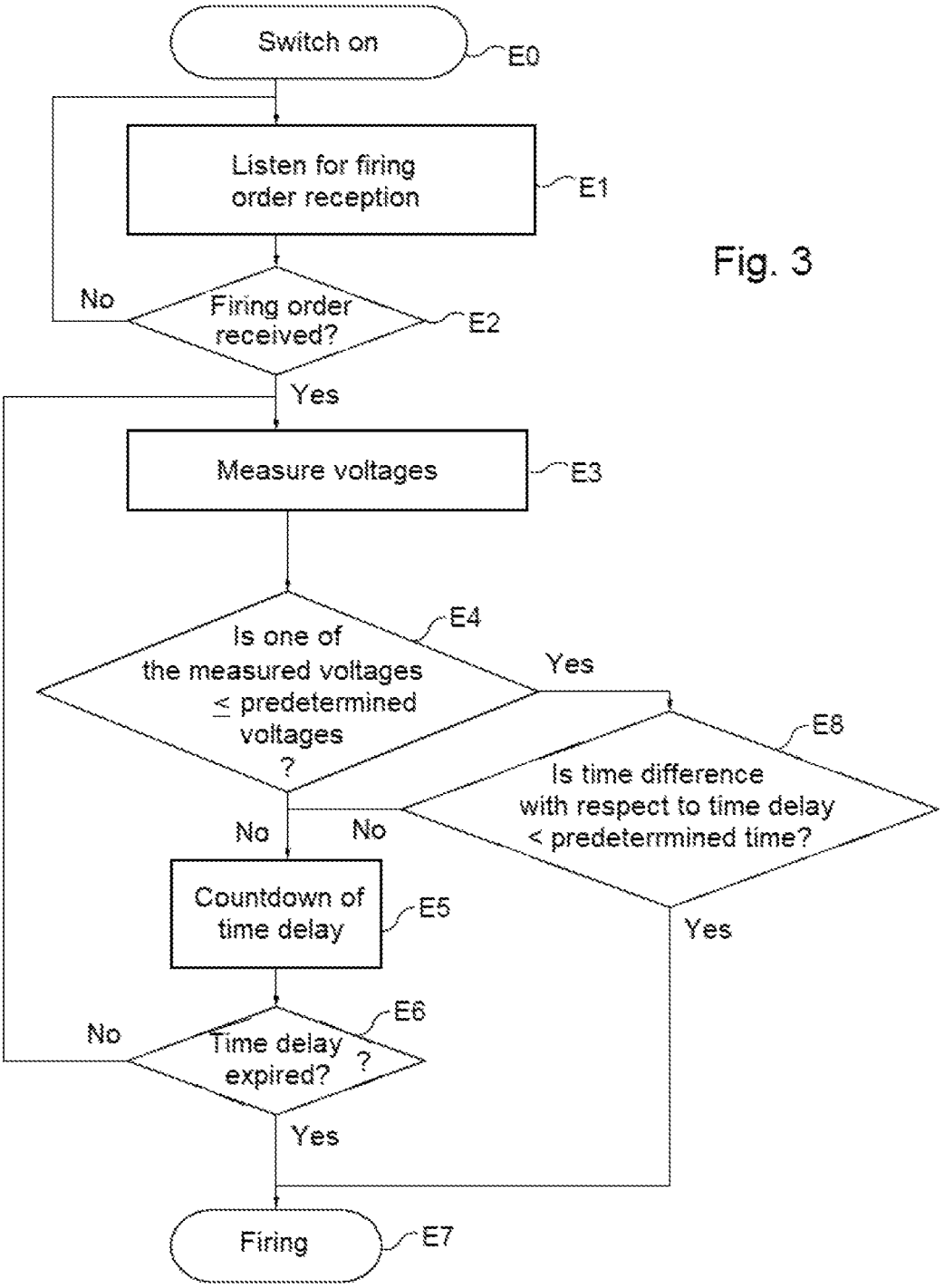
FIG. 3 shows a flow chart representing the method for firing an electronic detonator according to an embodiment of the invention.

FIG. 3 shows a flow chart representing a method for firing the electronic detonator according to an embodiment of the invention. The electronic detonator is such as that represented in FIG. 2. Of course, the firing method according to the invention may be implemented in electronic detonators according to other embodiments.

In a detonation system such as represented in FIG. 1, the electronic detonators 1, 2, . . . , N are supplied or switched on E0 by the firing unit 20 by the means of the electrically conducting wires 30.

When the electronic detonators 1, 2, . . . , N are switched on, they listen in order to detect reception of a firing order.

The electronic detonators 1, 2, . . . , N are thus placed in this step E1 of listening for a firing order.

Of course, the electronic detonators 1, 2, . . . , N can implement other tasks while still listening for a firing order.

Detection of the reception of a firing order is implemented during a step E2 of verifying the reception of a firing order.

When the reception of a firing order is detected during the verification step E2, the firing method comprises a step of measuring energy stored in the energy storage means 100.

In the embodiment described, the step of measuring the stored energy comprises a step E3 of measuring the voltage at the terminals of the energy storage means 100.

This step E3 of measuring the voltage at the terminals of the energy storage means 100 is implemented provided that a delay time associated with the electronic detonator 1 has not elapsed since reception of the firing order (or since detection of reception of the firing order in verification step E2).

In the embodiment described, corresponding to an electronic detonator such as that represented in FIG. 2, measurement of the voltage E3 at the terminals of the energy storage means 100 comprises a first measurement at the terminals of the supply capacitor 101 and a second measurement at the terminals of the firing capacitor 102.

Of course, when a single energy storage means is present in the electronic detonator 1, 2, . . . , N, a single voltage measurement is implemented.

Moreover, the firing method according to the invention comprises a step of comparing the measured stored energy with the predetermined energy.

In the embodiment described, the firing method comprises a step E4 of comparing the measured voltage with a predetermined voltage which is representative of a predetermined energy.

The predetermined energy corresponds to a minimum energy necessary for supplying and for firing the electronic detonator 1, 2, . . . , N.

Figure 4A:
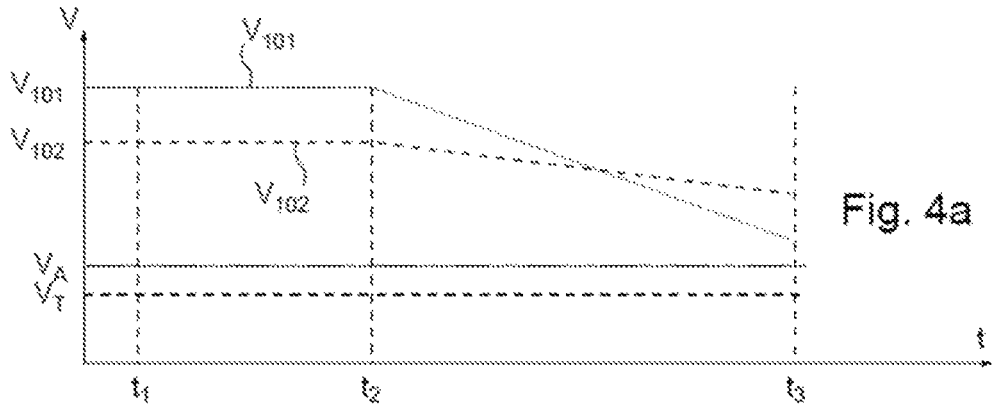
FIGS. 4*a*, 4*b* and 4*c* represent examples of evolution over time of the voltage at the terminals of the energy storage means.
Figure 4B:
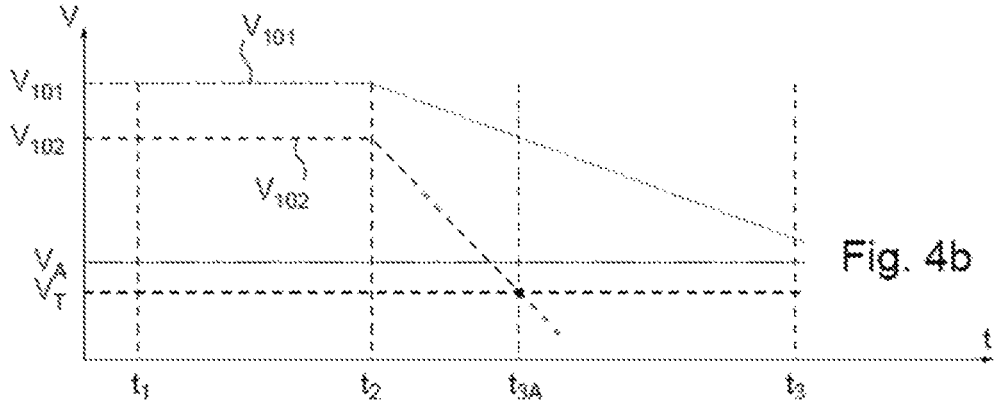
Figure 4C:
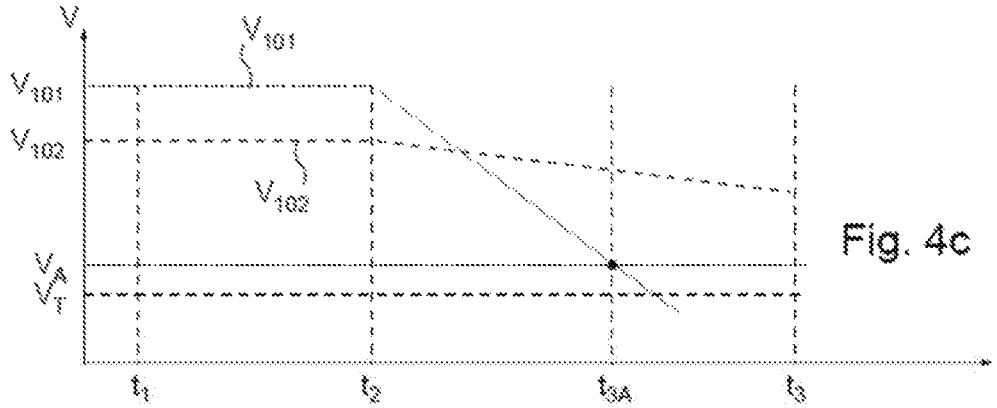

In an electronic detonator such as that represented in FIG. 2, the comparison step E4 comprises a first step of comparing the measured voltage at the terminals of the supply capacitor 101 with a first predetermined voltage $V_A$ (FIGS. 4*a*, 4*b* and 4*c*) and a second step of comparing the measured voltage at the terminals of the firing capacitor 102 with a second predetermined voltage $V_T$ (FIGS. 4*a*, 4*b* and 4*c*).

Of course, the values of the first predetermined voltage $V_A$ and of the second predetermined voltage $V_T$ can be different from or equal to each other.

The first predetermined voltage $V_A$ corresponds to the minimum energy necessary for supplying the electronic detonator. The second predetermined voltage $V_T$ corresponds to a second minimum energy necessary for the firing of the electronic detonator.

Of course, in the case of an electronic detonator comprising single energy storage means, a single voltage is measured at the terminals of the energy storage means, this voltage being compared with a single predetermined voltage corresponding to a minimum energy necessary for supplying and firing the electronic detonator 1, 2, . . . , N.

If in step E4 of comparing the measured stored energy with the predetermined energy, the measured energy is less than or equal to the predetermined energy, a firing step E7 is implemented (firing in advance).

In an electronic detonator such as that represented in FIG. 2, if during step E4 of comparing the voltage, the measured voltage at the terminals of the supply capacitor 101 is less than the first predetermined voltage $V_A$, and/or the measured voltage at the terminals of the firing capacitor 102 is less than or equal to the second predetermined voltage $V_T$, the firing step E7 is implemented.

Thus, when one of the voltages measured at the terminals of the supply capacitor 101 and of the firing capacitor 102 is less than or equal to the corresponding predetermined voltage $V_A$, $V_T$, the firing step E7 of the electronic detonator 1 is executed without waiting for the delay time associated with the electronic detonator to elapse.

In the embodiment represented in FIG. 3, when it is determined in comparison step E4 that at least one of the measured voltages is less than or equal to the corresponding predetermined voltage, the firing method further comprises a step E8 of determining the time difference existing between a period of time that has elapsed since reception of the firing order, and the delay time associated with the electronic detonator 1, 2, . . . , N.

When the determined time difference is less than a time value predetermined during this determination step E8, the firing E7 of the electronic detonator 1, 2, . . . , N is implemented.

On the contrary, when the difference determined in the determination step E8 is greater than a predetermined time value, the firing method continues with the step E5 of the countdown of the delay time.

Thus, in this embodiment, when a voltage at the terminals of the energy storage means 100 is less than or equal to a predetermined voltage and the time difference existing between a period of time elapsed since reception of the firing order and the delay time associated with the electronic detonator 1, 2, . . . , N is less than a predetermined time value, the firing step E7 is implemented even though the delay time associated with the electronic detonator 1 has not elapsed since reception of the firing order.

If in the comparison step E4, the voltages $V_{101}$, $V_{102}$ (FIGS. 4*a*, 4*b* and 4*c*) measured at the terminals of the supply capacitor 101 and of the firing capacitor 102 are respectively greater than the first predetermined voltages $V_A$, and the second predetermined voltage $V_T$, the countdown of the delay time E5 associated with the electronic detonator 1, 2, . . . , N continues.

During a verification step E6, it is verified whether the delay time associated with the electronic detonator 1 2, . . . N has elapsed from reception of the firing order. If so, the electronic detonator 1, 2, . . . , N is fired during the firing step E7.

It will be noted that the firing of the electronic detonator 1, 2, . . . , N once the delay time associated with it has elapsed, represents a case of firing which is implemented normally.

Provided that in the step E6 of verifying the delay time associated with the electronic detonator 1, 2, . . . , N, the delay time is not noted to have elapsed, the step E3 of measuring the voltage at the terminals of the energy storage means 100 (supply capacitor 101 and firing capacitor 102 in the embodiment described) as well as the step E4 of comparing the measured voltage with the predetermined voltage (first predetermined voltage $V_A$, and second predetermined voltage $V_T$) respectively is implemented.

FIGS. 4*a*, 4*b*, 4*c* show graphs representative of the values of voltages measured at the terminals of the supply capacitor 101 and at the terminals of the firing capacitor 102 as a function of time.

FIGS. 4*a*, 4*b* and 4*c* represent a level of a first predetermined voltage $V_A$ representing the minimum energy necessary for supplying the electronic detonator 1, 2, . . . , N, and a level of a second predetermined voltage $V_T$ representing the minimum energy necessary for the actual firing of the electronic detonator 1, 2, . . . , N.

The graph $V_{101}$ represents the voltage at the terminals of the supply capacitor 101, and the graph referenced $V_{102}$ represents the voltage at the terminals of the firing capacitor 102.

The moment in time $t_1$ represents a moment at which a firing order is received by the electronic detonator 1, 2, . . . , N (detection of the reception of a firing order during the step E2 of verifying the reception).

Thus, it is at this moment in time $t_1$, that the countdown of the delay time associated with the electronic detonator 1, 2, . . . , N commences.

The second moment in time $t_2$ represented in the figures represents the moment at which the electronic detonator 1, 2, . . . , N is no longer supplied or is partially supplied by the firing unit 20.

The third moment in time $t_3$ represents the moment at which the countdown of the delay time associated with the electronic detonator 1, 2, . . . , N has elapsed, a moment at which the electronic detonator 1, 2, . . . , N must be fired.

In FIG. 4*a*, the voltage at the terminals of the supply capacitor $V_{101}$ and that at the terminals of the firing capacitor $V_{102}$ reduce from the second moment in time $t_2$ and always remain greater than the predetermined voltages $V_T$, $V_A$ for the supply capacitor 101 and for the firing capacitor 102 until the delay time has elapsed.

Thus, in the case in point, the electronic detonator 1, 2, . . . , N is fired in firing step E7, once the delay time associated with it has elapsed.

In the case represented in FIG. 4*b*, the voltage at the terminals of the firing capacitor 102 reduces very rapidly so that at a moment $t_{3A}$, this voltage reaches the second predetermined voltage $V_T$ corresponding to the firing capacitor 102.

Then at this moment $t_{3A}$, the electronic detonator 1, 2, . . . , N is fired in advance, i.e. before the delay time has elapsed (moment $t_3$).

In the case in point represented in FIG. 4*c*, the voltage at a terminal of the supply capacitor 101 reduces very rapidly so that it reaches the first predetermined voltage $V_A$ before the delay time associated with the electronic detonator has elapsed (moment $t_3$).

The electronic detonator 1, 2, . . . , N is thus fired at this moment $t_{3A}$ in advance, i.e. before the associated delay time has elapsed (moment $t_3$).

The invention claimed is:

1. A method for firing an electronic detonator (1, 2, . . . , N) comprising energy storage means (100), the method comprising reception (E2) by the electronic detonator of a firing order, said method comprising the following steps that are implemented as long as a delay time associated with the electronic detonator (1, 2, . . . , N) has not elapsed since said reception (E2) of the firing order:

measuring (E3) a stored energy in said energy storage means (100), and firing (E7) said electronic detonator (1, 2, . . . , N) when the measured stored energy is less than or equal to a predetermined energy, wherein when said measured stored energy is less than or equal to said predetermined energy, determining (E8) the time difference existing between a period of time that has elapsed since reception of the firing order and said delay time associated with said electronic detonator (1, 2, . . . , N), said firing step (E7) being implemented when said time difference is less than a predetermined time value.

2. The firing method according to claim 1, wherein, said step of firing (E7) said electronic detonator (1, 2, . . . , N) is performed when the measured stored energy is equal to a predetermined energy and said predetermined energy corresponds to a minimum energy necessary for supplying and for firing said electronic detonator (1, 2, . . . , N).

3. The firing method according to claim 2, further comprising a step of comparing the measured stored energy to said predetermined energy.

4. The firing method according to claim 1, further comprising a step of comparing the measured stored energy to said predetermined energy.

5. The firing method according to claim 4, wherein said step of measuring the stored energy comprises a step (E3) of measuring a voltage at the terminals of the energy storage means, and said comparison step comprises a step (E4) of comparing said measured voltage with a predetermined voltage ($V_A$, $V_T$) representative of said predetermined energy.

6. An electronic detonator comprising energy storage means (100) and means for receiving a firing order (200, 201), said electronic detonator (1, 2, . . . , N) comprising:

means for measuring (200, 202, 203) a stored energy in said energy storage means (100), and means for firing (200, 201) configured for implementing the firing of said electronic detonator (1, 2, . . . , N) before a delay time associated with said electronic detonator (1, 2, . . . , N) has elapsed, when said stored energy measured by said measuring means is less than or equal to a predetermined energy, wherein the means for measuring and the means for firing implement a firing method comprising the following steps that are implemented as long as a delay time associated with the electronic detonator (1, 2, . . . , N) has not elapsed since said reception (E2) of the firing order:

measuring (E3) a stored energy in said energy storage means (100), and firing (E7) said electronic detonator (1, 2, . . . , N) when the measured stored energy is less than or equal to a predetermined energy, and when said stored energy measured by said measuring means is less than or equal to the predetermined energy determining (E8) the time difference existing between a period of time that has elapsed since reception of the firing order and said delay time associated with said electronic detonator (1, 2, . . . , N), said firing step (E7) being implemented when said time difference is less than a predetermined time value.

7. The electronic detonator according to claim 6, further comprising means for comparing (200, 201) the stored energy measured by the measuring means (200, 202, 203) with said predetermined energy.

8. The electronic detonator according to claim 7, wherein said means for measuring (200, 202, 203) the energy stored in said energy storage means (100) comprises means for measuring the voltage (200, 202, 203) at the terminals of said energy storage means (100), and said comparison means (200, 201) comprises means (200, 201) for comparing a voltage measured by said measuring means with a predetermined voltage ($V_A$, $V_T$) representative of the predetermined energy.

9. The electronic detonator according to claim 8, wherein said energy storage means (100) comprises a capacitor (101, 102).

10. The electronic detonator according to claim 7, wherein said energy storage means (100) comprises a capacitor (101, 102).

11. The electronic detonator according to claim 6, wherein said energy storage means (100) comprises a capacitor (101, 102).

12. A method for firing an electronic detonator (1, 2, . . . , N) comprising energy storage means (100), the method comprising reception (E2) by the electronic detonator of a firing order, said method comprising the following steps that are implemented as long as a delay time associated with the electronic detonator (1, 2, . . . , N) has not elapsed since said reception (E2) of the firing order:

measuring (E3) a stored energy in said energy storage means (100), and firing (E7) said electronic detonator (1, 2, . . . , N) when the measured stored energy is less than or equal to a predetermined energy, wherein said predetermined energy corresponds to a energy necessary for supplying and for firing said electronic detonator (1, 2, . . . , N), and wherein when said measured stored energy is less than or equal to said predetermined energy, the method further comprises a step of determining (E8) the time difference existing between a period of time that has elapsed since reception of the firing order and said delay time associated with said electronic detonator (1, 2, . . . , N), said firing step (E7) being implemented when said time difference is less than a predetermined time value.

13. A method for firing an electronic detonator (1, 2, . . . , N) comprising energy storage means (100), the method comprising reception (E2) by the electronic detonator of a firing order, said method comprising the following steps that are implemented as long as a delay time associated with the electronic detonator (1, 2, . . . , N) has not elapsed since said reception (E2) of the firing order:

measuring (E3) a stored energy in said energy storage means (100), and firing (E7) said electronic detonator (1, 2, . . . , N) when the measured stored energy is less than or equal to a predetermined energy, comparing the measured stored energy to said predetermined energy, wherein said step of measuring the stored energy comprises a step (E3) of measuring a voltage at the terminals of the energy storage means, and said comparison step comprises a step (E4) of comparing said measured voltage with a predetermined voltage (VA, VT) representative of said predetermined energy, and wherein when said measured stored energy is less than or equal to said predetermined energy, the method further comprises a step of determining (E8) the time difference existing between a period of time that has elapsed since reception of the firing order and said delay time associated with said electronic detonator (1, 2, . . . , N), said firing step (E7) being implemented when said time difference is less than a predetermined time value.

* * * * *